United States Patent [19]

Arakawa

[11] 4,351,369

[45] Sep. 28, 1982

[54] FLUID SUPPLY APPARATUS IN SHUTTLELESS LOOM

[75] Inventor: Hiroshi Arakawa, Kariya, Japan

[73] Assignee: Kabushiki Kaisha Toyoda Jidoshokki Seisakusho, Aichi, Japan

[21] Appl. No.: 100,288

[22] Filed: Dec. 5, 1979

[30] Foreign Application Priority Data

Dec. 12, 1978 [JP] Japan ..... 53/15417
Dec. 12, 1978 [JP] Japan ..... 53/15418
Dec. 12, 1978 [JP] Japan ..... 53/171681[U]

[51] Int. Cl.[3] ..... D03D 47/30
[52] U.S. Cl. ..... 139/435; 139/452
[58] Field of Search ..... 139/435, 450, 452

[56] References Cited

U.S. PATENT DOCUMENTS 3,376,901 4/1968 Te Strake ..... 139/435
3,502,253 3/1970 Van Mullekom ..... 139/452
3,580,444 5/1971 Mullekom ..... 139/435
4,128,114 12/1978 Tanaka ..... 139/435

*Primary Examiner*—Henry Jaudon
*Attorney, Agent, or Firm*—Burgess, Ryan and Wayne

[57] ABSTRACT

In a shuttleless loom provided with a gripper which repeats the gripping and releasing of a weft in synchronism with the weft inserting operation, a fluid supply apparatus comprises a compressed fluid source, a valve mechanism having a fluid entrance and at least one fluid discharge exit, a pipe means connecting said compressed fluid source to said fluid entrance of the valve mechanism, at least one nozzle disposed at a given position in the loom, and a connecting means connecting said nozzle to said fluid discharge exit. The valve mechanism is actuated in synchronism with the gripping and releasing operation of the gripper.

16 Claims, 15 Drawing Figures

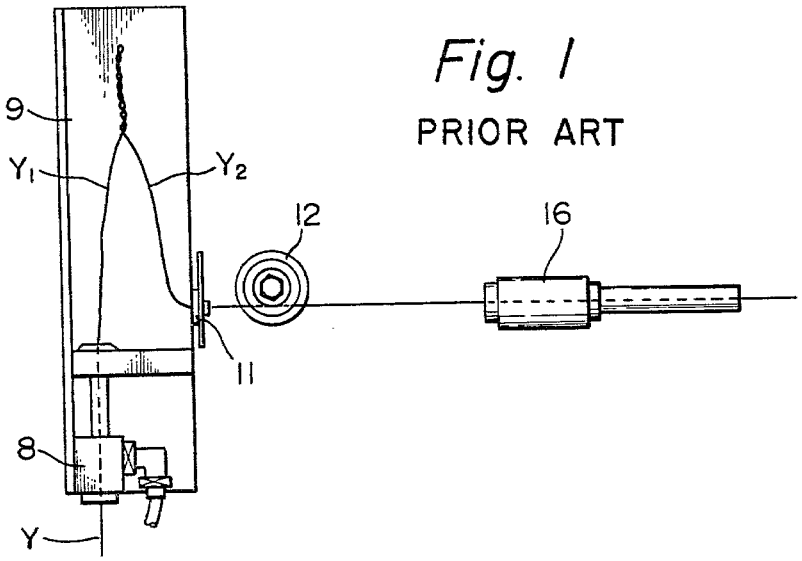
Fig. 1
PRIOR ART
Fig. 3
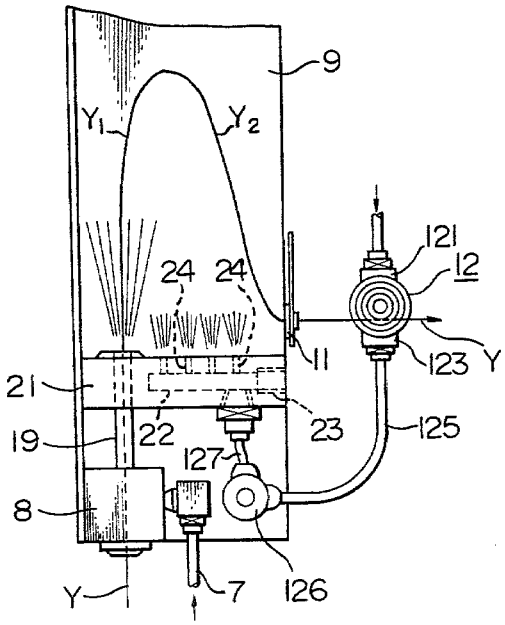

FLUID SUPPLY APPARATUS IN SHUTTLELESS LOOM

BACKGROUND OF THE INVENTION

The present invention relates to a fluid supply apparatus in a shuttleless loom provided with a gripper which is arranged upstream of weft inserting means and operates in such a manner that the gripper releases a weft during the weft inserting operation and grips a weft from after the weft inserting operation to the start of next weft inserting operation.

In a shuttleless loom, because of the weft inserting mechanism for intermittently inserting the weft, in the side portion of the machine stand, there are ordinarily disposed a tensor for imparting a predetermined tension to the weft delivered out from a stationarily disposed weft feed zone, a weft storing zone for storing a predetermined quantity of the weft, a gripper arranged in the travelling course of the weft extended from the weft storing zone to weft inserting means and a cutter located on the end of a woven fabric to cut the weft at every weft inserting operation. However, heretofore there have been various problems which cause failures in the weft inserting operation in a shuttleless loom in connection with such an intermittent weft inserting operation. For example, in a shuttleless loom wherein a weft is temporarily reserved almost in a U-shaped form in a weft storing zone, a stored weft becomes entangled with itself and this will cause a failure in the weft inserting operation. That is, as illustrated in FIG. 1, in a conventional shuttleless loom if the loom is stopped because of erroneous weft inserting or yarn breakage during the operation, or if the loom is stopped out of necessity, while the loom is at a standstill, the loom is kept in the state ready for the weft inserting operation. Accordingly, the weft is kept in the U-shaped form on the storing plate 9. During this period of stoppage of the loom, however, the storing fluid jetting device 8 is working and the gripper 12 continues gripping the weft. Therefore, the weft $Y_1$ on the delivery side of the storing plate 9 receives a tension of the fluid jetted from the storing fluid jetting device 8 and is kept stretched, but since the weft inserting operation is not performed, the weft $Y_2$ on the take-out side receives no tension and is kept relaxed. Consequently, the weft $Y_2$ is entangled with the weft $Y_1$ on the delivery side by a strong return-twisting force to form an entangled portion $Y_3$. The entanglement of the entangled portion $Y_3$ is promoted by a turbulent flow caused by the fluid jetted from the storing fluid jetting device 8 because the weft $Y_2$ on the take-out side is kept in the tension less state. When the loom is started again while entanglement is thus formed in the stored weft, the entangled or twisted portion $Y_3$ is passed through the gripper 12 as it is and is brought to the weft inserting jet nozzle 16. Accordingly, the weft inserting jet nozzle 16 becomes clogged with the entangled portion of the weft and the weft inserting operation becomes impossible or an erroneous weft inserting occurs.

Even while the loom is being operated, since the gripper 12 is closed to grip the weft during the period of storing the weft after the weft inserting, the weft $Y_2$ on the take-out side is kept in the tensionless state before a predetermined amount of the weft is stored, though the time during which the weft $Y_2$ is kept in such free state is short. Accordingly, entanglement is often formed in the weft even while the loom is being operated.

Another problem which will cause a failure in the weft inserting operation is that fly wastes are generated and these fly wastes readily deposit on a tensor, a stored weft in the storing zone, a gripper and a cutter. For example, if fly wastes adhere to the tensor or gripper, the pressing force or gripping force on the weft is weakened, and it becomes impossible to impart a predetermined tension to the weft or to control the weft. Moreover, if a mass of fly wastes adheres to the weft, when a fluid jet nozzle is used for storing of the weft, this nozzle is readily clogged, and in the case of a jet loom, a weft inserting jet nozzle is similarly clogged, with the result that the weft storing operation or weft inserting operation cannot be performed.

As means for overcoming the disadvantage caused by fly wastes, there have heretofore been proposed a method in which a fluid is blown onto the gripper to remove fly wastes therefrom and a method in which fluid is jetted from the interior of the gripper in the radial direction toward the weft-gripping surface to remove fly wastes from the gripper, as disclosed in Japanese Patent Application Laid-Open Specification No. 78364/78, Japanese Utility Model Application Laid-Open Specifications No. 94870/76 and No. 94872/76. In these conventional techniques, however, since importance is attached only to removal of fly wastes, the weft inserting operation is more or less disturbed by the above-mentioned arrangement. More specifically, since the operation of removing fly wastes from the weft-gripping portion of the gripper is performed while the weft-gripping portion is opened to release the weft, that is, while the weft is advanced and the weft inserting operation is conducted, the weft is seriously influenced by the fluid jetted for removal of fly wastes and a large resistance is imposed on the weft inserting operation. Especially in the case of a jet loom, since the weft inserting operation is performed by the action of the fluid, erroneous weft inserting is readily caused by the influence of the fly waste-removing fluid on the weft.

Furthermore, if fly wastes deposited in the weft storing zone adhere to the weft, the fly wastes are carried to the subsequent gripper to weaken the gripping force of the gripper, and in the case of a jet loom, fly wastes not adhering to the gripper are further delivered to the weft inserting jet nozzle and this nozzle becomes clogged, with the result that the weft inserting operation becomes impossible. Since the cutter has to cut the weft at every weft inserting operation and it must be used very frequently with an accurate cutting capacity, if fly wastes are deposited on the cutter, the cutting function is degraded to render the weft inserting operation impossible.

Furthermore, in respective parts where removal of fly wastes is necessary, the removing operation must be performed at different timings. For example, the operation of removing fly wastes from the gripper should be performed while the gripper releases the weft. On the other hand, the operation of removing fly wastes from the weft storing zone should be performed during storing of the weft, that is, while the gripper grips the weft, because a large resistance is given to the weft if the fluid is jetted for removal of fly wastes during the weft inserting operation. Therefore, operations of removing fly wastes from the respective parts should be performed at different timings which are determined in such a manner that they are dependent on the respective functions.

SUMMARY OF THE INVENTION

It is an object of the present invention to provide a fluid supply apparatus which supplies fluid to one or more parts in a shuttleless loom, in the required timing in connection with the weft inserting operation, so as to prevent a failure in the weft inserting operation.

Another object of the present invention is to provide a fluid supply apparatus which can intermittently supply fluid in synchronization with the weft inserting operation, without provision of a special timing device.

A further object of the present invention is to provide a fluid supply apparatus which is advantageous from the view point of power consumption efficiency.

According to the present invention, in a shuttleless loom provided with a gripper which repeats the gripping and releasing of a weft in synchronism with the weft inserting operation, a fluid supply apparatus comprises a compressed fluid source, a valve mechanism having a fluid entrance and at least one fluid discharge exit, a pipe means connecting said compressed fluid source to said fluid entrance of the valve mechanism, at least one nozzle disposed at an given position in the loom, and a connecting means connecting said nozzle to said fluid discharge exit, said valve mechanism is actuated in synchronism with the gripping and releasing operation of the gripper.

Other objects and advantages of the present invention will be apparent from the following description with reference to the accompanying drawings. It is to be understood, however, that the drawings are for the purpose of illustration only and are not intended as a definition of the limits of the invention.

BRIEF DESCRIPTION OF THE DRAWINGS

FIG. 1 is a schematic plan view showing a weft storing zone, a gripper and a fluid jet nozzle for a weft in a conventional jet loom.

FIG. 3 is a schematic plan view of the embodiment of the present invention illustrated in FIG. 2.

DETAILED DESCRIPTION OF PREFERRED EMBODIMENTS

The present invention will now be described in detail with reference to an embodiment illustrated in the accompanying drawings, in which the fluid supply apparatus of the present invention is applied to a jet loom.

Figure 2:
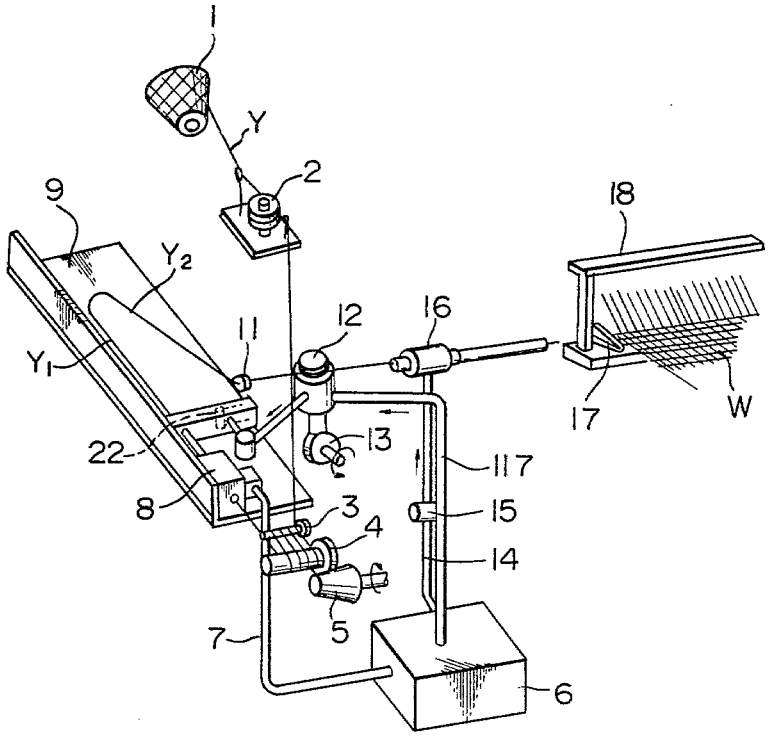
FIG. 2 is a schematic perspective view of a jet loom with one embodiment of a fluid supply apparatus of the present invention.

Referring to FIG. 2, in the side portion of the machine stand, a weft Y delivered out from a stationarily disposed weft feed zone 1 is passed through a tensor 2, by which a predetermined tension is given to the weft Y. The weft Y is guided to a length-measuring delivery zone comprising a guide roller 3, a length-measuring roller 4 and a driving roller 5. The weft Y, measured and delivered by this zone, is then stored on a storing plate 9 substantially in a U-shaped form, by a storing fluid jetting device 8 connected to a compressed fluid source 6 through a pipe 7. The weft $Y_2$ on the take-out is passed through a guide 11 and a weft-gripping portion of a gripper 12 driven by a cam 13, and is guided to a weft inserting jet nozzle 16 connected to the compressed fluid source 6 through a pipe 14 and a valve 15. Then, the weft is inserted into a shed at a predetermined timing. On the end of a woven fabric W, a cutter 17 is disposed, which is appropriately driven to cut the weft at every weft inserting operation. Reference numeral 18 represents a reed.

As shown FIG. 3, a storing fluid jetting device 8 is mounted on a storing plate 9 constituting the weft storing zone, and a nozzle 19 of the storing fluid jetting device 8 is disposed to pierce a frame 21 fixed to the storing plate 9 and is opened toward the weft storing zone. The storing fluid jetting device 8 is connected to a compressed fluid source 6 through a pipe 7 and a compressed fluid is always jetted from the nozzle 19. A fluid-distributing blind hole 22 is formed on the frame 21 and is sealed by a screw 23. An auxiliary nozzle 24, opened to the weft storing zone, is connected to the distributing hole 22 to impart a predetermined tension to a weft $Y_2$ on the take-out side, and an auxiliary fluid jetting device is constructed by such distributing plate and auxiliary nozzle. In the embodiment illustrated in the drawings, four auxiliary nozzles 24 are provided, but the number of the auxiliary nozzles 24 is not particularly critical and one or two auxiliary nozzles 24 may be provided.

Figure 4:
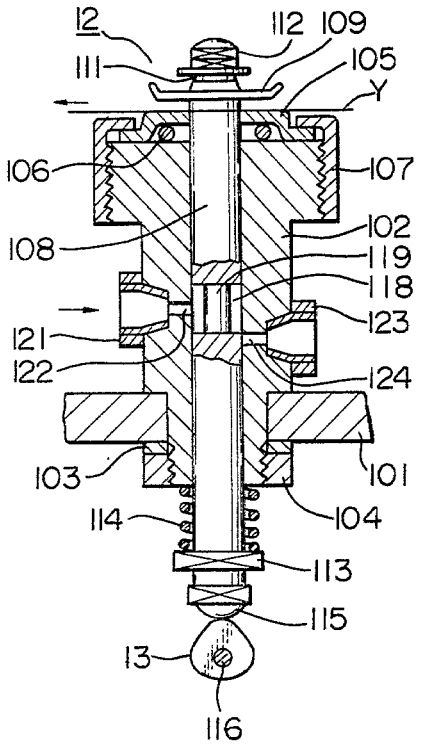
FIG. 4 is a sectional view of a gripper applied to the embodiment of FIG. 3, with gripper in a weft releasing condition.
Figure 5:
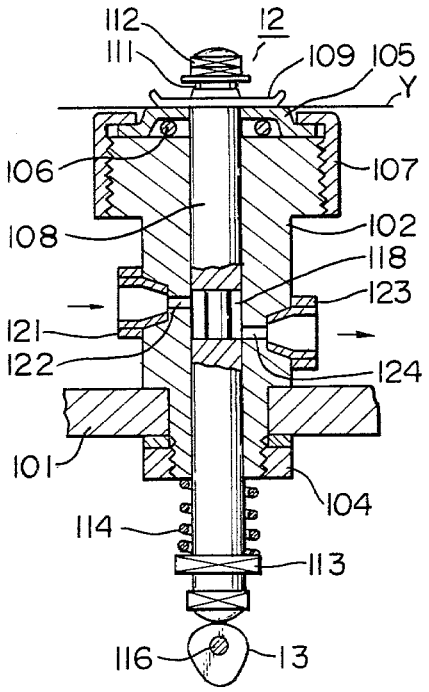
FIG. 5 is a sectional view of the gripper illustrated in FIG. 4, but with the gripper in a weft gripping condition.

According to the present invention a gripper 12 for gripping the weft which is passed through a guide 11 disposed in the vicinity of the weft storing zone and is guided to a weft inserting jet nozzle 16 acting as the weft inserting means has a structure as illustrated in FIGS. 4 and 5. More specifically, a T-shaped body 102 is fixed to a frame 101 through a washer 103 by a screw 104. A stationary weft-gripping member 105 is placed on the top face of the body 102 through a rubber ring 106 and is fixed thereto by a screw member 107. A rod 108 slidably pierces the body 102 substantially in the central portion thereof, and a movable weft-gripping member 109 is attached to the top end of the rod 108 through a rubber ring 111 by a nut 112. The rod 108 is downwardly urged by a spring 114 interposed between a nut 113 disposed on the bottom end of the rod 108 and the lower face of the body 102. The lowermost face 115 of the rod 108 is lifted for a predetermined time synchronously with the weft inserting operation by appropriate lifting means such as a cam 13 mounted on a shaft 116. The peripheral face of the rod 108 is partially notched to form an annular room 118 between a small-diameter part 119 of the rod 108 and the inner circumferential face of the body 102. A feed entrance 121 connected to the compressed fluid source through a pipe 117 and a fluid discharge exit 123 are attached to the body 102, and they are communicated with the space 118 through holes 122 and 124, respectively. The feed entrance 121 is always communicated with the room i.e. space 118, but the discharge exit 123 is arranged so that the communication of the discharge exit 123 with the space 118 is shut while the rod 108 is upwardly moved, that is, while the weft is released, and the discharge exit 123 is communicated with the space 118 while the rod 108 is downwardly moved, that is, while the weft is gripped. Thus, the gripper 12 constitutes a fluid changeover valve device.

The distributing hole 22 of the auxiliary fluid jetting device is connected to the discharge exit 123 of the gripper 12 through a pipe 125, a needle valve 126 and a pipe 127, and the fluid issued from the discharge exit 123 is jetted from the auxiliary nozzle 24 through the distributing hole 22 after the flow rate has been adjusted by the needle valve 126.

In the above-mentioned structure, when the weft inserting operation by the weft inserting jet nozzle 16 is completed while the loom is being operated, the rod 108 of the gripper 12 is downwardly moved by the spring 114 and the weft Y is gripped between the movable weft gripping member 109 and the stationary weft gripping member 105. Accordingly, the weft Y being delivered out from the stationary weft feed zone is passed through the nozzle 19 and jetted out to the storing zone on the storing plate 9 by the fluid jetted from the storing fluid jetting device 8, and the weft is consecutively stored between the storing zone and the guide 11 in the U-shaped form. Simultaneously, by the downward movement of the rod 108, the hole 124 of the discharge exit 123 is communicated with the space 118, and therefore, the compressed fluid on the side of the feed entrance 121 is passed through the hole 122, space 118, hole 124, discharge exit 123 and pipe 125, and is then jetted from the auxiliary nozzle 24 through the pipe 127 and distributing hole 22 after the flow rate has been adjusted by the needle valve 126. The fluid jetted from the auxiliary nozzle 24 acts on the weft $Y_2$ on the take-out side which is gripped by the gripper 12 and kept in the relaxed state, so that a tension is imposed in the direction separating this weft $Y_2$ from the weft $Y_1$ on the delivery side. Accordingly, entanglement of the weft $Y_2$ on the take-out side by return-twisting or the like is prevented during the weft storing operation. When a predetermined quantity of the weft has been thus stored, the rod 108 of the gripper 12 is upwardly moved by appropriate driving means, and as shown in FIG. 4, the movable weft gripping member 109 releases the weft Y and the weft inserting operation is performed by the weft inserting jet nozzle 16. Simultaneously, the hole 124 of the discharge exit 123 of the gripper 12 is disconnected from the space 118, and jetting of the fluid from the auxiliary nozzle 24 is stopped. Accordingly, while the weft inserting operation is conducted, that is, while the weft is taken out from the weft storing zone, no influence of the fluid is imposed on the weft $Y_2$ on the take-out side and therefore, no running resistance is imparted to the weft being inserted. Furthermore, since no fluid is jetted from the auxiliary nozzle 22 unless necessary, excessive consumption of power is prevented.

Furthermore, when the loom is stopped, the state before initiation of the weft inserting operation is maintained and although the weft is stored substantially in the U-shaped form in the weft storing zone on the storing plate 9, the gripper 12 is kept in the state where the movable weft gripping member 109 is brought down to grip the weft, as shown in FIG. 5. Accordingly, the feed entrance 121 is communicated with the discharge exit 123 through the space 118, and therefore, the fluid is jetted from the auxiliary nozzle 24 and the weft $Y_2$ on the take-out side receives a tension acting in the direction separating the weft $Y_2$ from the weft $Y_1$ on the delivery side. Consequently, entanglement of the weft in the weft storing zone can be prevented while the loom is stopped.

Figure 6:
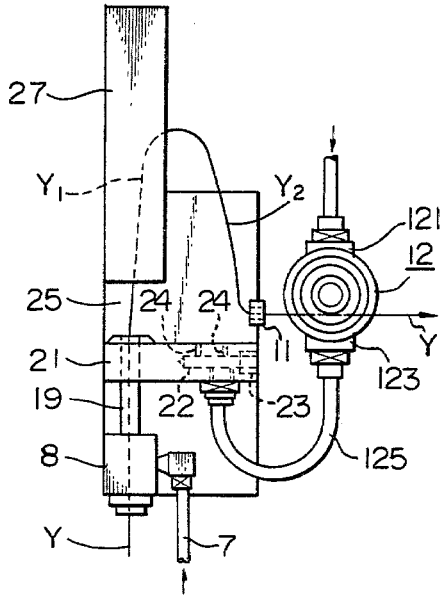
FIG. 6 is a schematic plan view like FIG. 3, illustrating another embodiment of the present invention.
Figure 7:
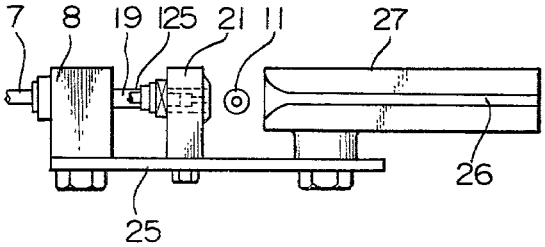
FIG. 7 is a side view of the weft storing device illustrated in FIG. 6.

FIGS. 6 and 7 illustrate another embodiment of the present invention. In this embodiment, a storing fluid jetting device 8 is mounted on a stand 25 fixed to the machine frame, and a nozzle 19 of the jetting device 8 pierces a frame 21 mounted on the stand 25. A distributing hole 22 sealed by a screw 23 is formed on the frame 21 and an auxiliary nozzle 24 is connected to the distributing hole 22 to constitute an auxiliary fluid jetting device. The storing fluid jetting device 8 is connected to a compressed fluid source 6 through a pipe 7, and the auxiliary nozzle 24 is connected to a discharge exit 123 of a gripper 12, which has a structure as illustrated in FIGS. 4 and 5, through a pipe 125.

A storing ring 27, having a slit 26 confronting the opening of the nozzle 19 of the storing fluid jetting device 8, is fixed to the stand 25 to define a storing zone for the weft $Y_1$ on the delivery side. The weft $Y_2$ on the take-out side between the slit 26 of the storing ring 27 and a guide 11 is present in the open air. The auxiliary nozzle 24 is arranged so that the weft $Y_2$ present in the open air on the take-out side receives a tension acting in the direction separating the weft $Y_2$ from the weft $Y_1$ on the delivery side. Also in the embodiment having the structure shown in FIGS. 6 and 7, the same functions as exerted in the above-mentioned embodiment shown in FIGS. 2 through 5 can be similarly exerted.

In each of the foregoing embodiments, the auxiliary nozzle 24 need not be arranged in parallel to the fluid jetting device 8 as shown in the drawings. It is only required that the auxiliary nozzle 24 should be arranged so that the weft $Y_2$ on the take-out side receives a tension acting in the direction separating the weft $Y_2$ from the weft $Y_1$ on the delivery side. For Example, the auxiliary nozzle 24 may be located at a position corresponding to the top end of the U-figured shape of the stored weft so that the fluid is jetted to the weft $Y_2$ on the take-out side at said position, from above or below said position or from the side of said position. The fluid changeover function is given to the gripper 12 per se in the foregoing embodiments. However, in the present invention, it is possible to adopt a modification in which a fluid changeover valve mechanism is independently disposed and the valve is changed over by utilizing the movement of the gripper 12.

As pointed out hereinbefore, entanglement of the weft in the weft storing zone is caused because a part of the weft being stored is relaxed in the tensionless state while the weft is gripped by the gripper. According to the present invention, an auxiliary fluid jetting device for imparting a tension to the weft on the take-out side of the weft storing zone is disposed and arranged so that the fluid is jetted from the auxiliary fluid jetting device co-operatively with the gripper only when the weft is gripped by the gripper. Accordingly, in the present invention, the fluid is jetted so that a predetermined tension is inevitably imposed on the weft on the take-out side while the weft is stored, irrespective of whether the loom is operated or stopped. Therefore, entanglement of the weft being stored can be prevented very effectively, and the weft inserting operation can be performed stably according to the present invention.

Figure 8:
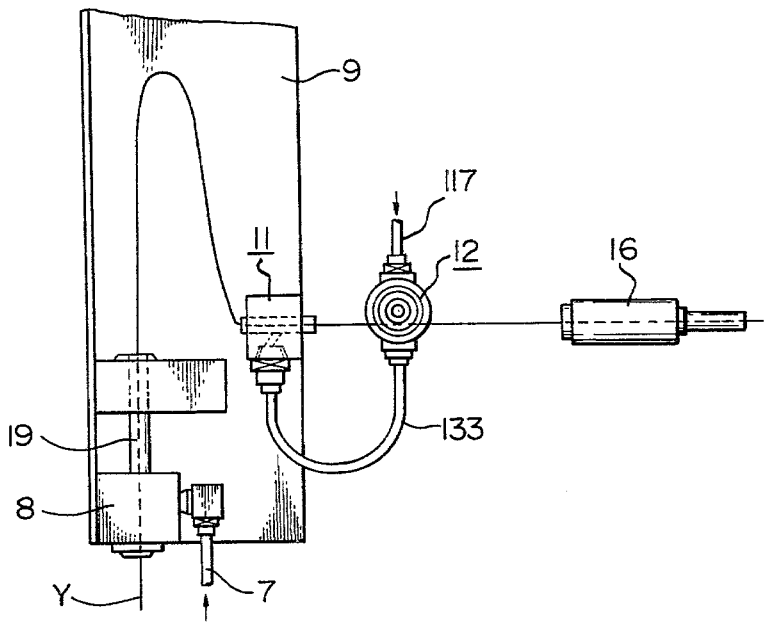
FIG. 8 is a schematic plan view of another embodiment of the present invention.
Figure 9:
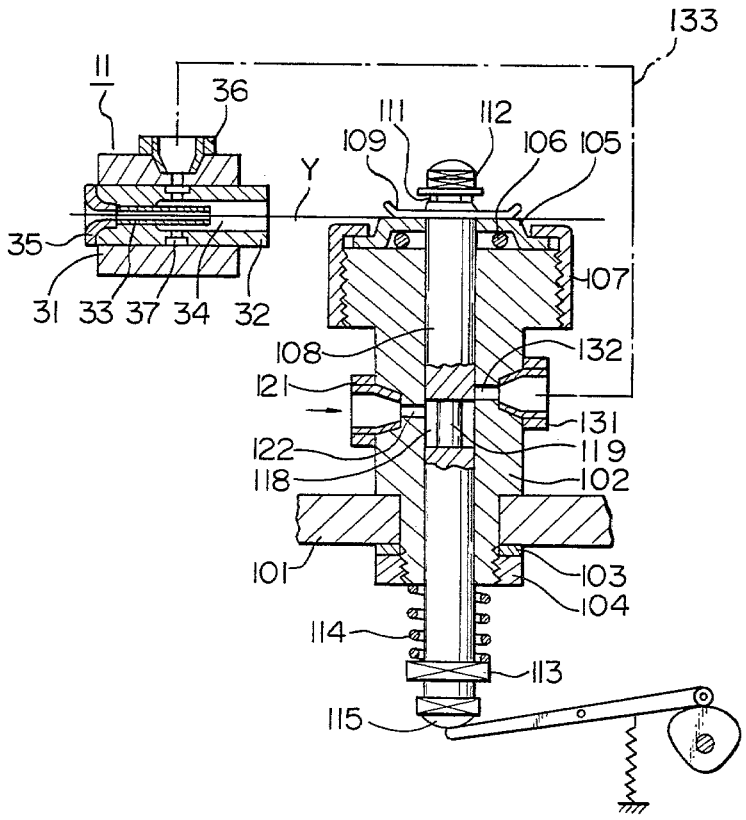
FIG. 9 is a sectional view of the embodiment illustrated in FIG. 8, wherein the gripper is in a weft gripping condition.
Figure 10:
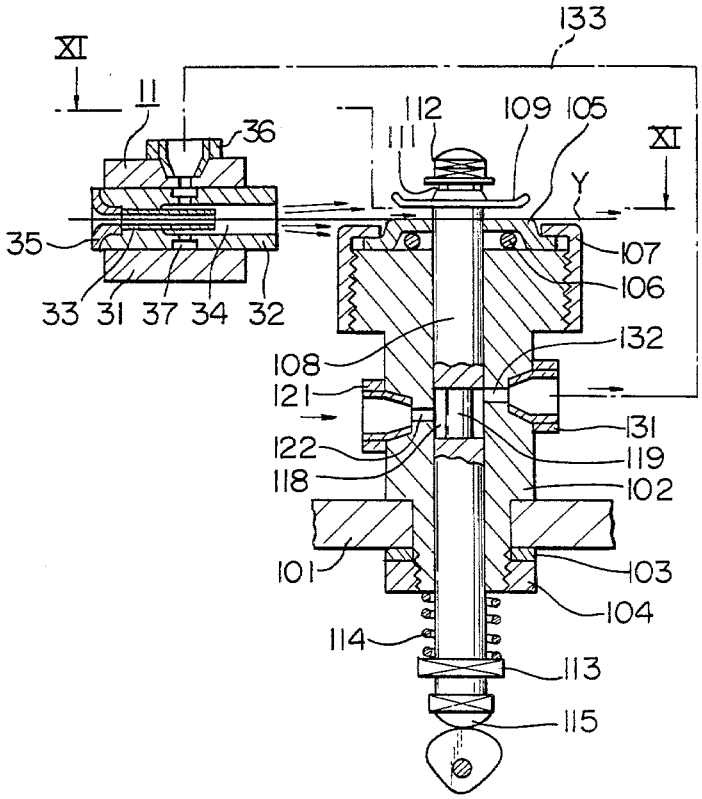
FIG. 10 is a sectional view of the embodiment illustrated in FIG. 8, but with the gripper in a weft releasing condition.

FIG. 8 through FIG. 11 illustrate another embodiment of a fluid supply apparatus of the present invention. As illustrated in FIG. 8, according to this embodiment, a fluid supply apparatus is connected to the guide 11. In FIGS. 9 and 10 the same members as in FIGS. 1 through 7 have same reference numerals as in FIGS. 1 through 7, and a detailed explanation of such members is omitted here.

A fluid supply entrance 121 connected to the compressed fluid source through a pipe 117 is attached to the body 102, and also a fluid discharge exit 131 is attached to the body 102. The fluid supply entrance 121 is always communicated with the space 118 through a hole 122, but the fluid discharge exit 131 is arranged so that when the rod 108 is brought down to close the weft-gripping portion as shown in FIG. 9, a communication hole 132 for the exit 131 is shut and the exit 131 is disconnected from the space 118 and that when the rod 108 is lifted up to open the weft-gripping portion as shown in FIG. 10, the exit 131 is communicated with the space 118 through the hole 132. Thus, there is constructed a fluid changeover valve mechanism utilizing the contacting and separating motions of the gripper 12.

The guide 11 comprises a frame 31 fixed to the storing plate 9, a nozzle 32 fitted in and fixed to the frame 31 and a conduit pipe 33 fitted and fixed in the nozzle 32. The conduit pipe 33 is arranged so that the weft Y is passed therethrough, and the top end of the conduit pipe 33 is projected into an inner space 34 of the nozzle 32 and a trumpet-shaped weft-introducing guide 35 is attached to the rear end of the conduit pipe 33. A fluid supply entrance 36 connected to the discharge exit 131 of the gripper 12 through a pipe 133 is attached to the frame 31, and this entrance 36 is communicated with the inner space 34 of the nozzle 32 through a communication hole 37. Accordingly, the fluid supplied is passed through the communication hole 37 and introduced into the inner space 34, and the fluid is then jetted from the nozzle 32. This nozzle 32 is directed toward the weft-gripping portion of the gripper 12 so that the jetting direction is in agreement with the advance direction of the weft Y.

Figure 11:
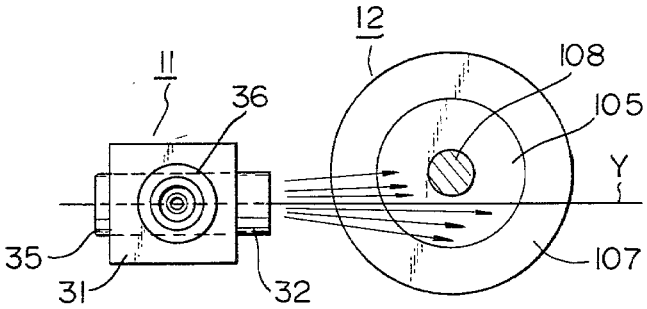
FIG. 11 is a sectional plan view taken along XI—XI line shown FIG. 10 and illustrating the action of fluid in the gripper illustrated in FIG. 10.

In the above-mentioned structure, upon completion of the weft inserting operation, the rod 108 of the gripper 12 is brought down as illustrated in FIG. 9, and the gripper 12 grips the weft Y by the weft-gripping portion. Accordingly, the weft blown out from the storing fluid jetting device 8 is consecutively stored on the storing plate 9. When a predetermined quantity of the weft is stored, the rod 108 of the gripper 12 is lifted up by driving means as illustrated in FIG. 10 to release the weft, and the weft inserting operation by the weft inserting jet nozzle 16 is initiated. Simultaneously, the communication hole 132 of the fluid discharge exit 131 is brought into communication with the space 118. Accordingly, the fluid supplied to the supply entrance 121 is fed to the supply entrance 36 of the guide 11 through the communication hole 122, space 118, communication hole 132, discharge exit 131 and pipe 133 and is jetted from the nozzle 32. As illustrated in FIGS. 10 and 11 the fluid jetted from the nozzle 32 is blown into between the opened stationary gripping member 105 and movable gripping member 109 to blow away and remove fly wastes deposited in the weft-gripping portion. Furthermore, since the fluid jetted from the nozzle 32 flows along the direction of advance of the weft Y, the advancing movement of the weft is promoted by the jetted fluid, whereby the running resistance on the weft can be reduced and the weft inserting capacity of the weft inserting jet nozzle 16 can be auxiliarily enhanced. Thus, during the weft inserting operation, that is, while the weft is released from the weft-gripping portion the fluid is jetted from the nozzle 32, and on completion of the weft inserting operation, the weft-gripping portion is closed as illustrated in FIG. 9 and, simultaneously, supply of the fluid to the nozzle 32 is shut off.

In the foregoing embodiment, supply of the fluid to the nozzle is performed by the changeover valve function given to the gripper 12. However, in the present invention, it is possible to adopt a modification in which a fluid changeover supply mechanism is independently disposed.

As will be apparent from the above explanation, according to an embodiment of the present invention illustrated in FIGS. 8 through 11, a fluid jetting nozzle also acting as a weft guide is arranged upstream of a gripper for repeating the gripping and releasing of a weft delivered out synchronism from a stationarily disposed weft feed zone and guided to weft inserting means in synchronism with the weft inserting operation, so that the jetting direction of the fluid jetting nozzle is caused to be in agreement with the direction of advance of the weft, and the fluid is jetted from the fluid jetting nozzle only while the weft is released from the weft-gripping portion of the gripper. By virtue of this structural feature, according to the present invention, fly wastes deposited on the weft-gripping portion of the gripper can be blown away and removed, and; since the jetted fluid acts on the weft along the direction of advance of the weft, the advancing motion of the weft is promoted by the jetted fluid, whereby the running resistance on the weft can be reduced and the weft inserting capacity can be auxiliarily enhanced.

FIGS. 12 through 15 illustrate an embodiment of a fluid supply apparatus of the present invention. In this embodiment the same members as in the other embodiments described above, are indicated with the same reference numerals, and a detailed explanation regarding the members is omitted here. The feature of this embodiment resides in the fact that there are two discharge exits in a gripper, one of which has the same function as that illustrated in FIGS. 4 and 5, and the other of which has the same function as that illustrated in FIGS. 9 and 10.

Figure 13:
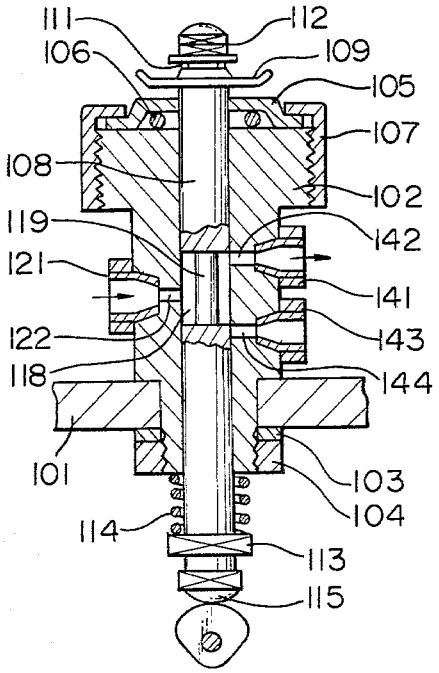
FIG. 13 is a sectional view of a gripper applied to the embodiment of FIG. 12, with the gripper in a weft releasing condition.
Figure 14:
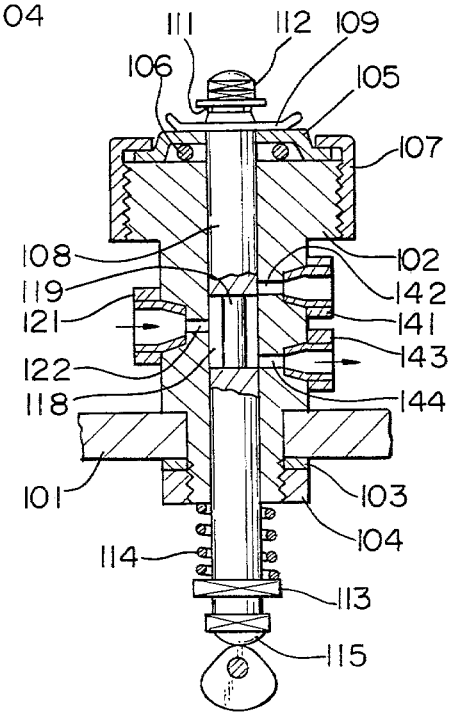
FIG. 14 is a sectional view of the gripper illustrated in FIG. 13, with the gripper in a weft grinding condition.
Figure 15:
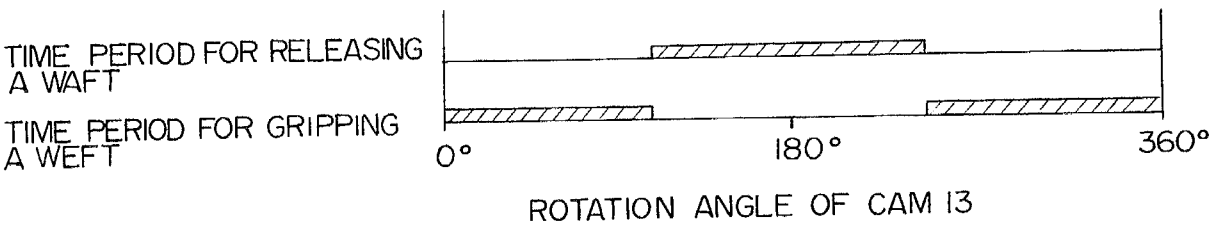
FIG. 15 is a timing diagram showing weft releasing duration and weft gripping duration.

According to this embodiments, a fluid supply entrance 121 is always communicated with the fluid passage space 118 through a communication hole 122, but the fluid discharge exits 141 and 143 are arranged so that the fluid discharge exit 141 is communicated with the fluid passage space 118 through a communication hole 142 only while the movable gripping member 109 is lifted up to release the weft, as illustrated in FIG. 13 and the other fluid discharge exit 143 is communicated with the fluid passage space 118 through a communication hole 144 only while the movable gripping member 109 is brought down to grip the weft, as illustrated in FIG. 14. Thus, the operation of changing over the supply of the fluid is performed by utilizing the contacting and separating actions of the gripper 12.

One fluid discharge exit 141 of the gripper 12 is connected to a distributor 146 through a pipe 145, and the distributor 146 is connected to a nozzle 32 disposed in the guide 11 through a pipe 147 to supply the fluid for removing fly wastes from the gripper 12. Furthermore, the distributor 146 is connected to a nozzle 149 through a pipe 148 to supply the fluid for removing fly wastes from the tensor 2 and is also connected to a nozzle 152 through a pipe 151 to supply the fluid for removing fly wastes from the cutter 17. The other fluid discharge exit 143 is directly connected to a nozzle 154 through a pipe 153 to jet the fluid to the weft $Y_2$ on the take-out side on the storing plate 9 to remove fly wastes from the storing plate 9 or the areas adjacent thereto. Moreover, entanglement or twisting of the weft $Y_1$ on the delivery side, which is caused by the tension-free state of the weft $Y_2$ on the take-out side, can be effectively prevented by the fluid jetted from the nozzle 154.

In the above-mentioned structure, the weft Y delivered out from the stationary weft feed zone 1 is measured by the length measuring roller 5 and delivered along a predetermined length while a predetermined tension is imparted thereto by the tensor 2, and the weft $Y_1$ is then stored on the storing plate 9. Then, the weft Y is guided to the weft inserting jet nozzle 16 through the guide 11 and gripper 12. When the loom is operated, the weft is stored on the storing plate 9 while the weft is gripped by the gripper 12, and when a predetermined quantity of the weft is stored, the weft is released from the gripper 12, and simultaneously, the weft inserting operation is performed by the weft inserting jet nozzle 16. On completion of the weft inserting operation, the gripper 12 grips the weft again and the weft is stored on the storing plate 9. While the weft is thus gripped by the gripper 12, the rod 108 is brought down as shown in FIG. 14. Accordingly, the fluid discharge exit 143 is brought into communication with the fluid passage space 118 and the fluid is jetted to the weft $Y_2$ being stored on the take-out side, from the nozzle 154 through the pipe 153, whereby fly wastes are removed and a predetermined tension is imparted to the weft $Y_2$ on the take-out side. When a predetermined quantity of the weft is stored, the rod 108 of the gripper 12 is lifted up as illustrated in FIG. 13 and the weft is released from the gripper 12. Accordingly, the fluid discharge exit 141 is communicated with the fluid passage space 118, and the fluid is passed through the distributor and is jetted to the weft-gripping portion of the gripper 12 from the nozzle 32, and to the tensor 2 and cutter 17 from the nozzles 149 and 152, respectively. As a result, fly wastes are removed from the weft-gripping portion of the gripper 12, the tensor 2 and the cutter 17. In the above-mentioned manner, the fluid is intermittently jetted to the positions where jetting of the fluid is necessary, at appropriate timings adjusted synchronously with the weaving motion during the operation of the loom.

No particular timing is necessary for the operation of removing fly wastes from the tensor 2 and cutter 17. Accordingly, the pipes 148 and 151 may be connected to the other fluid discharge exit 143 through the distributor. However, as is seen from the timing diagram of FIG. 15, the time for releasing the weft from the gripper is much shorter than the time for gripping the weft by the gripper. Accordingly, from the viewpoint of effective power consumption, it is preferred that the fluid be supplied to the tensor 2 and cutter 17 from the fluid discharge exit 141 as in the above-mentioned embodiment.

Figure 12:
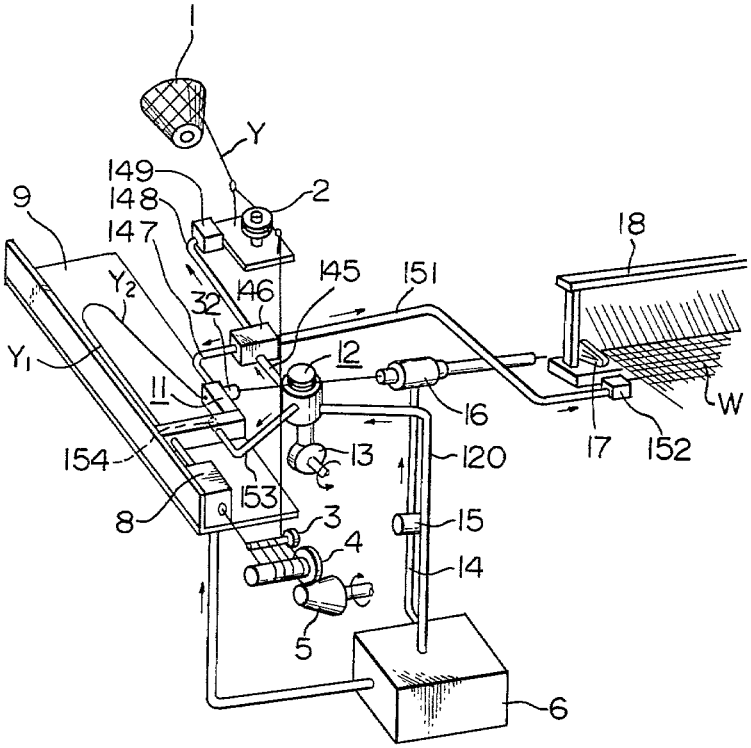
FIG. 12 is a schematic perspective view of a loom provided with an embodiment of the present invention.

As will be apparent from the above explanation, according to the embodiment illustrated in FIGS. 12 through 14, a fluid supply entrance and two fluid discharge exits are formed on a gripper disposed in a weft travelling course leading to weft inserting means, to repeat the operations of gripping and releasing the weft, so that the fluid is supplied to either of the fluid discharge exits according to the contacting or separating action of the gripper. By virtue of this structural feature, according to the present device, the fluid can be supplied to the respective parts differing in the required timing of jetting and the fly waste-removing operation can be performed effectively in the respective parts. Furthermore, the fluid supply apparatus of the present device is advantageous from the viewpoint of power consumption efficiency, because the fluid can be jetted intermittently.

What is claimed is:

1. A fluid supply apparatus in a shuttleless loom provided with a gripper which repeats the gripping and releasing of a weft in synchronism with the weft inserting operation, comprising a compressed fluid source, a valve mechanism having a fluid entrance and at least one fluid discharge exit, said gripper having a movable member which forms a part of said valve mechanism, a pipe means connecting said compressed fluid source to said fluid entrance of the valve mechanism, at least one nozzle disposed at a position apart from said gripper in the loom, a connecting means connecting said nozzle to said fluid discharge exit, and actuating means for actuating said valve mechanism in synchronism with the gripping and releasing operation of the gripper.

2. A fluid supply apparatus according to claim 1, wherein said movable member of the gripper is a rod supporting a movable gripping member of the gripper.

3. A fluid supply apparatus according to claim 1, wherein a body of the gripper forms a part of said valve mechanism, and said body is provided with said fluid entrance and said fluid discharge exit.

4. A fluid supply apparatus in a shuttleless loom provided with a gripper which repeats the gripping and releasing of a weft in synchronism with the weft inserting operation, comprising a compressed fluid source, a valve mechanism having a fluid entrance and at least one fluid discharge exit, a pipe means connecting said compressed fluid source to said fluid entrance of the valve mechanism, at least one nozzle disposed at a position apart from and upstream of said gripper in the loom, a connecting means connecting said nozzle to said fluid discharge exit, and actuating means operatively associated with said gripper for actuating said valve mechanism in synchronism with the releasing operation of the gripper to cause said valve mechanism to communicate said fluid discharge exit with said fluid entrance of the valve mechanism to eject fluid from said nozzle only when said gripper grips a weft.

5. A fluid supply apparatus according to claim 4 wherein said nozzle is disposed in a weft storing zone and is connected to said fluid discharge exit which is communicated with said fluid entrance only when the gripper grips a weft, so that the nozzle blows fluid towards a U-shape stored weft.

6. A fluid supply apparatus in a shuttleless loom provided with a gripper which repeats the gripping and releasing of a weft in synchronism with the weft inserting operation, comprising a compressed fluid source, a valve mechanism having a fluid entrance and at least one fluid discharge exit, a pipe means connecting said compressed fluid source to said fluid entrance of the valve mechanism, at least one nozzle disposed at a position apart from and upstream of said gripper in the loom, a connecting means connecting said nozzle to said fluid discharge exit, and actuating means operatively associated with said gripper for actuating said valve mechanism in synchronism with the releasing operation of the gripper to cause said valve mechanism to communicate said fluid discharge exit with said fluid entrance of the valve mechanism to eject fluid from said nozzle only when said gripper releases a weft.

7. A fluid supply apparatus according to claim 6 wherein a nozzle is disposed in a guide positioned upstream of the gripper, is directed to the gripper, and is connected to said fluid discharge exit, which is communicated with said fluid entrance when the gripper releases a weft.

8. A fluid supply apparatus according to claim 6, wherein a nozzle is disposed near a tensor, is directed to the tensor, and is connected to said fluid discharge exit, which is communicated with said fluid entrance only when the gripper releases a weft.

9. A fluid supply apparatus according to claim 6, wherein a nozzle is disposed near a cutter is directed to the cutter, and is connected to said fluid discharge exit, which is communicated with said fluid entrance only when the gripper releases a weft.

10. A fluid supply apparatus according to claim 6, wherein the fluid discharge exit, which is communicated with the fluid entrance when the gripper releases a weft, is connected to the nozzles via a distributor.

11. A fluid supply apparatus according to claim 4 or 6, wherein said valve mechanism has two fluid discharge exits, one of which is communicated with said fluid entrance only when the gripper grips a weft, and the other of which is communicated with the fluid entrance only when the gripper releases a weft.

12. A fluid supply apparatus according to claim 4 or 6, wherein said connecting means is a pipe.

13. A fluid supply apparatus according to claim 4 or 6, wherein said connecting means comprises a distributor and pipes.

14. A fluid supply apparatus in a shuttleless loom provided with a gripper which repeats the gripping and releasing of a weft in synchronism with the weft inserting operation, comprising a compressed fluid source, a valve mechanism having a fluid entrance and at least one fluid discharge exit, a pipe means connecting said compressed fluid source to said fluid entrance of the valve mechanism, at least one nozzle disposed at a position apart from said gripper in the loom, a connecting means connecting said nozzle to said fluid discharge exit, and actuating means for actuating said valve mechanism in synchronism with the gripping and releasing operation of the gripper, said gripper comprising a body of the gripper fixed to a machine frame, a stationary weft-gripping member placed on said body, a rod slidably piercing said body and a movable weft-gripping member attached to the top end of said rod, said rod and body respectively forming parts of said valve mechanism, said body being provided with said fluid entrance and said fluid discharge exit, said rod of the gripper having a small-diameter part, an annular space being formed between said small-diameter part and the inner wall of the body of the gripper, said space being always communicated with the fluid entrance and being communicated with a fluid discharge exit when the gripper grips a weft.

15. A fluid supply apparatus according to claim 14, wherein said actuating means comprises a cam which is directly contacted with the lower end of said rod.

16. A fluid supply apparatus according to claim 14, wherein said rod of the gripper has a small-diameter part, and an annular room is formed between said small-diameter part and the inner wall of the body of the gripper, said room being always communicated with the fluid entrance and being communicated with a fluid discharge exit when the gripper release a weft.

* * * * *

UNITED STATES PATENT AND TRADEMARK OFFICE

CERTIFICATE OF CORRECTION

PATENT NO. : 4,351,369

DATED : September 18, 1982

INVENTOR(S) : Hiroshi Arakawa

It is certified that error appears in the above—identified patent and that said Letters Patent is hereby corrected as shown below:

Column 3, line 25: delete "an" and insert --a--.

Column 4, line 5: delete "grinding" and insert --gripping--.

On the title page, the priority data should read as follows:

"53/15417" should be --53/154517--

"53/15418" should be 53/154518

Signed and Sealed this

*Sixteenth* Day of *August 1983*

[SEAL]

*Attest:*

GERALD J. MOSSINGHOFF

*Attesting Officer*

*Commissioner of Patents and Trademarks*